US010617181B2

(12) United States Patent
Rich

(10) Patent No.: US 10,617,181 B2
(45) Date of Patent: Apr. 14, 2020

(54) SEPARABLE BRACELET BAND

(71) Applicant: Michael James Rich, Mandisonville, LA (US)

(72) Inventor: Michael James Rich, Mandisonville, LA (US)

( * ) Notice: Subject to any disclaimer, the term of this patent is extended or adjusted under 35 U.S.C. 154(b) by 0 days.

(21) Appl. No.: 16/238,716

(22) Filed: Jan. 3, 2019

(65) Prior Publication Data

US 2019/0133266 A1 May 9, 2019

Related U.S. Application Data

(63) Continuation-in-part of application No. 29/672,159, filed on Dec. 3, 2018, and a continuation-in-part of application No. 13/680,033, filed on Nov. 17, 2012, now Pat. No. 10,306,956.

(60) Provisional application No. 61/611,396, filed on Mar. 15, 2012.

(51) Int. Cl.
*A44C 5/00* (2006.01)
*G09F 3/00* (2006.01)

(52) U.S. Cl.
CPC ..... *A44C 5/0007* (2013.01); *A44C 5/0053* (2013.01); *G09F 3/005* (2013.01)

(58) Field of Classification Search
CPC ..... A44C 5/0007; A44C 5/00; A44C 5/0023; A44C 9/00; A44C 9/0038; A44C 9/0053
USPC ..... 63/3, 11
See application file for complete search history.

(56) References Cited

U.S. PATENT DOCUMENTS

2012/0159988 A1* 6/2012 Baird ..... A44C 5/102 63/11
2014/0116086 A1* 5/2014 Casaccio ..... A44C 5/0053 63/5.1

* cited by examiner

*Primary Examiner* — Jack W Lavinder

(57) ABSTRACT

A separable bracelet band is an apparatus that represents a significant relationship between at least two people. The separable bracelet is separated by an individual into at least two bracelets, each of which is worn by another individual. The separable bracelet includes a tubular body and at least one separation track. The tubular body represents the relationship or connection between at least two people. The tubular body, itself, may be worn as a bracelet. The tubular body is separable into at least two other bracelets along the at least one separation track. The tubular body includes a first open end, a second open end, an inner surface, and an outer surface. The at least one separation track is positioned in between the first open end and the second open end. The at least one separation track is circumferentially integrated around the tubular body.

18 Claims, 12 Drawing Sheets

SEPARABLE BRACELET BAND

The current application is a continuation-in-part (CIP) application of the U.S. non-provisional application Ser. No. 13/680,033 filed on Nov. 17, 2012.

The current application is also a CIP application of the U.S. design application Ser. No. 29/672,159 filed on Dec. 3, 2018.

FIELD OF THE INVENTION

The present invention generally relates to jewelry. More specifically, the present invention is a separable bracelet band that represents friendship.

BACKGROUND OF THE INVENTION

For centuries, people have always worn symbols of friendship around their wrist. However, friendship bracelets are always one-sided with one friend handing another friend a single bracelet to symbolize an effective visual unity and connect the two friends together. Because it was a one-way system, after a while, the friendship bracelet could never be traced back to the friend who gave them the bracelet. There is a need for improved friendship bracelets that can provide a proper link between or among friends who wear the friendship bracelet.

It is therefore an objective of the present invention to define a proper link between friends who wear a part of the bracelet. Moreover, the present invention serves as a symbol that connects at least two friends to each other by wearing portion of a bracelet that used to be a single bracelet. The friendship bracelet of the present invention produces two or more individual bracelets, stemming from one bracelet. The preferred embodiment of the present invention is made of silicone in order for an individual to easily separate the present invention into multiple bracelets.

DETAIL DESCRIPTIONS OF THE INVENTION

All illustrations of the drawings are for the purpose of describing selected versions of the present invention and are not intended to limit the scope of the present invention.

Figure 1:
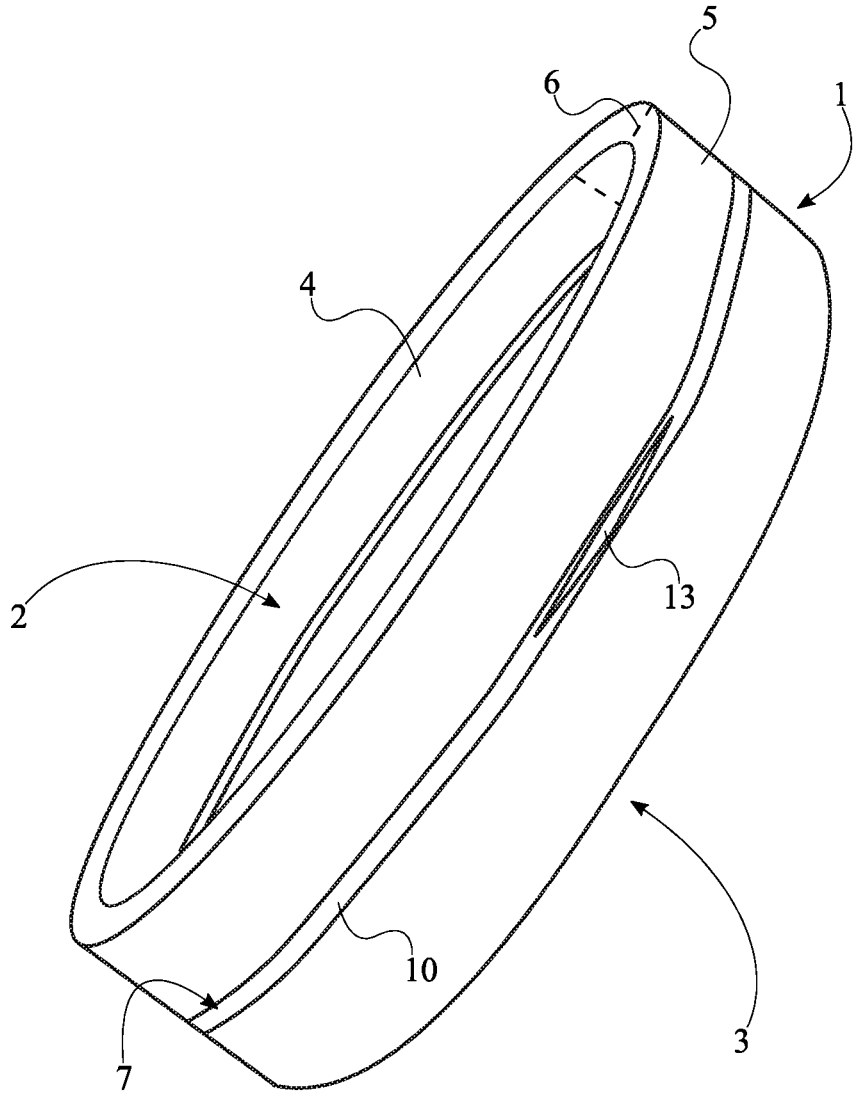
FIG. 1 is a front perspective view of the present invention.
Figure 2:
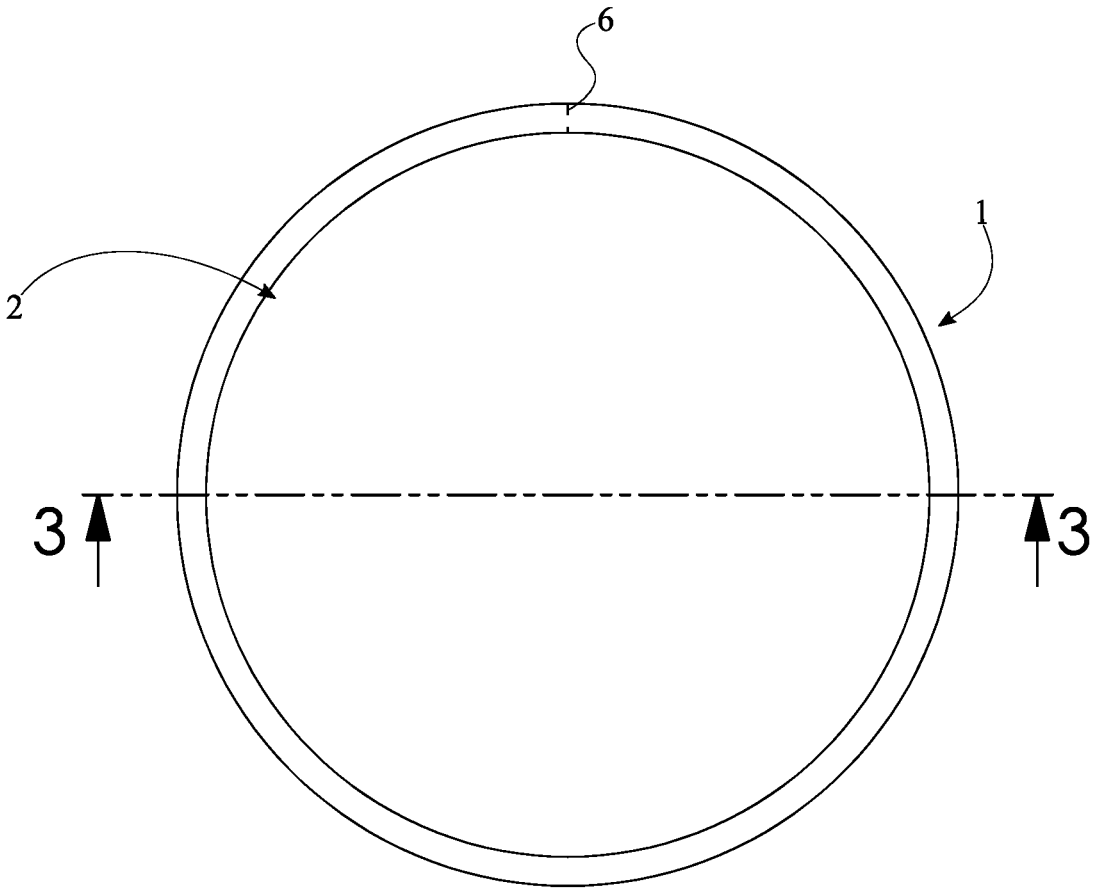
FIG. 2 is a top side view of the present invention.

The present invention is a separable bracelet band that is shared by at least two individuals. These individuals are preferably friends but may also be individuals that are related or have a close emotional connection. The separable bracelet may be worn by an individual until he or she wishes to share the present invention with at least one other individual. In order for the present invention to be worn and shared, the present invention comprises a tubular body 1 and at least one separation track 7, as seen in FIG. 1. The tubular body 1 surrounds the wrist of an individual and serves as a bracelet. The tubular body 1 is a single unit that symbolizes a bond between two or more individuals. Upon the separation of the tubular body 1, the at least two bracelets symbolize the affiliation of an individual with another. In order for the tubular body 1 itself to be used as a bracelet, the tubular body 1 comprises a first open end 2, a second open end 3, an inner surface 4, and an outer surface 5, shown in FIG. 1, FIG. 3, FIG. 4, FIG. 5, FIG. 6, FIG. 7, FIG. 8, FIG. 9, and FIG. 10. The first open end 2 allows a hand to enter the tubular body 1, and the second open end 3 allows the hand to exit the tubular body 1. The inner surface 4 comes into contact with the wrist of the user. The outer surface 5 is viewable by the individual wearing the tubular body 1 and other individuals near the tubular body 1. The outer surface 5 may comprise a variety of aesthetic components and feature a variety of designs in order to reflect desired stylistic preferences of the individuals who wear the separated positions of the tubular body 1. The at least one separation track 7 defines where the tubular body 1 separates into at least two bracelets.

The overall configuration of the aforementioned components allows the tubular body 1 to separate into at least two bracelets with clean edges. The at least one separation track 7 is positioned in between the first open end 2 and the second open end 3. The tubular body 1 is separable into at least two bracelets as the at least one separation track 7 is circumferentially integrated around the tubular body 1, as seen in FIG. 1. The at least separation track 7 is preferably linear about the tubular body 1. However, alternate embodiments of the present invention may comprise at least one separation track 7 with curves, waves, zig-zags, and so on, in order to enhance the overall aesthetic of both the tubular band and the at least two bracelets that tubular body 1 is separated into by an individual.

Figure 9:
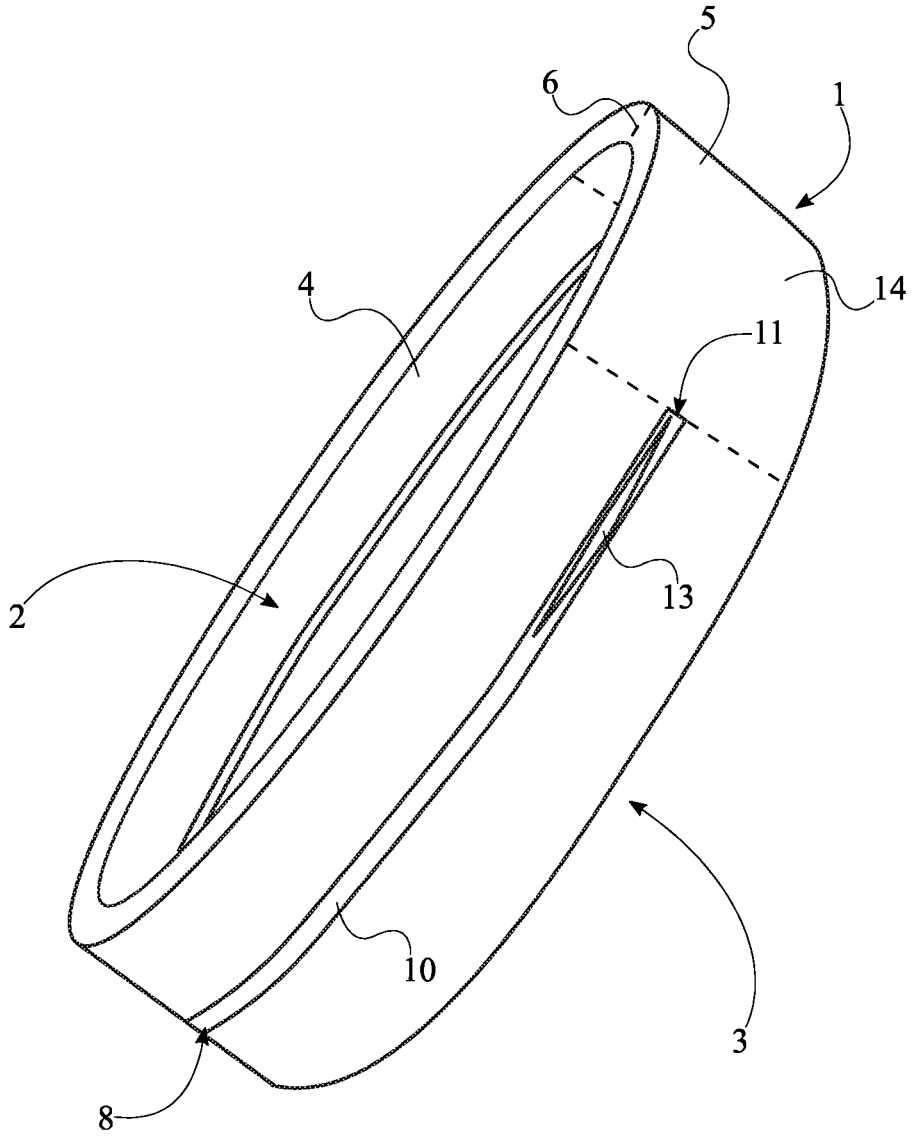
FIG. 9 is a front perspective view of the alternate embodiment of the present invention with a single track.

In the preferred embodiment of the present invention, the at least one separation track 7 is a single track 8 in order to separate the tubular body 1 into two bracelets, as seen in FIG. 9. The single track 8 is positioned equidistant between the first open end 2 and the second open end 3 in order to equally divide and share the tubular body 1. It is understood that alternate embodiments of the present invention may comprise a single track 8 that is unequally distributed in order to vary the width of each individual bracelet, accommodating the preferences of each individual.

Figure 10:
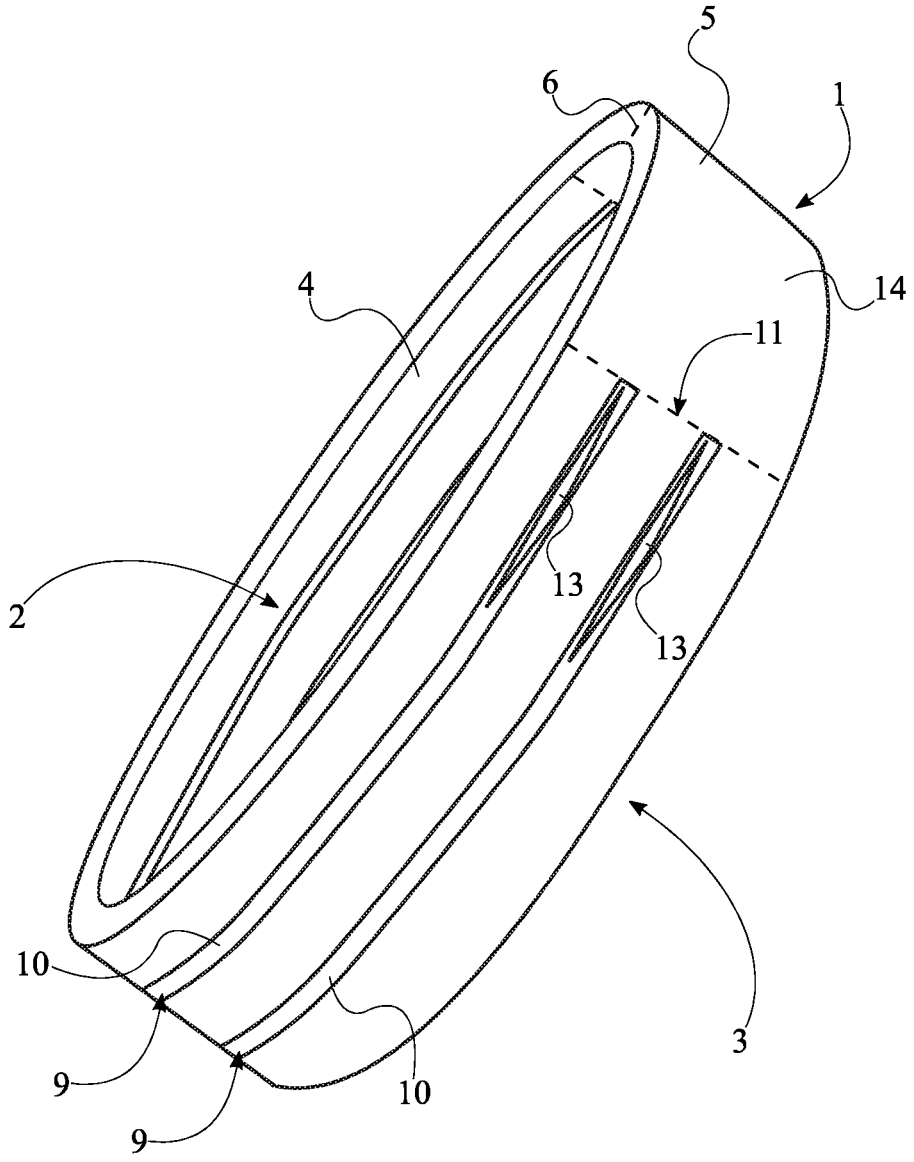
FIG. 10 is a front perspective view of the alternate embodiment of the present invention with a plurality of tracks.

In an alternate embodiment of the present invention, the at least one separation track 7 is a plurality of tracks 9, seen in FIG. 10. The plurality of tracks 9 allows an individual with more than one individual. This alternate embodiment represents a unity between a group of friends, siblings, and so on. In order to share the tubular body 1 among multiple individuals, the plurality of tracks 9 is equally distributed along the tubular body 1. It is understood that alternate embodiments of the present invention may comprise a plurality of tracks 9 that is unequally distributed in order to vary the width of each individual bracelet, accommodating the preferences of each individual.

In the preferred embodiment of the present invention, the at least one separation track 7 comprises an indented segment 10 and a slit segment 13, shown in FIG. 1, FIG. 3, FIG. 4, FIG. 5, FIG. 6, FIG. 7, FIG. 8, FIG. 9, and FIG. 10. The indented segment 10 both defines the path of separation and keeps the tubular body 1 as a single unit until an individual separates the tubular body 1 into at least two bracelets. More specifically, the indented segment 10 comprises a first end 11 and a second end 12, which define the indented segment 10. The slit segment 13 facilitates the separation of the tubular body 1 into at least two bracelets along the indented segment 10. In order to define the path of separation for the tubular body 1, the indented segment 10 laterally traverses into the tubular body 1 from the outer surface 5. Similarly, the slit segment 13 laterally traverses through the tubular body 1 from the outer surface 5 to the inner surface 4. In order to facilitate the separation of the tubular body 1 into at least two bracelets, the slit segment 13 is circumferentially positioned in between the first end 11 and the second end 12. An individual my insert the tip of a finger into the slit segment 13 and tear the tubular body 1 along the indented segment 10. Alternate embodiments of the present invention may include at least one separation track 7 with more than one slit segment 13 in order to allow multiple individuals to separate the tubular body 1 into multiple bracelets simultaneously.

In the preferred embodiment of the present invention, a wall thickness 6 of the tubular body 1 is positioned in between the inner surface 4 and the outer surface 5. The indented segment 10 laterally traverses 90% of the wall thickness 6 in order to ensure clean edges along the indented segment 10.

In alternate embodiments of the present invention, the at least one separation track 7 further comprises a stabilizing segment 14, shown in FIG. 4, FIG. 5, FIG. 6, FIG. 7, FIG. 8, FIG. 9, and FIG. 10 The stabilizing segment 14 preserves the overall structure of tubular body 1 unless purposefully separated into at least two bracelets by an individual. In order to preserve the overall structure of the tubular body 1, the stabilizing segment 14 is circumferentially positioned in between the slit segment 13 and the second end 12.

Figure 3:
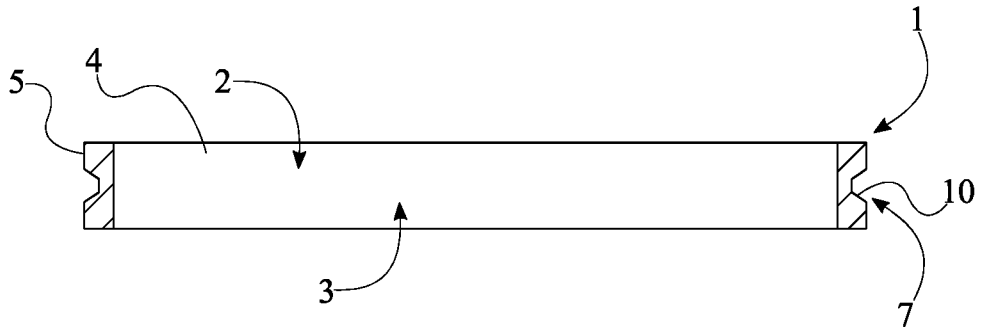
FIG. 3 is a cross-section view of FIG. 2 along line 3-3 of the present invention.
Figure 4:
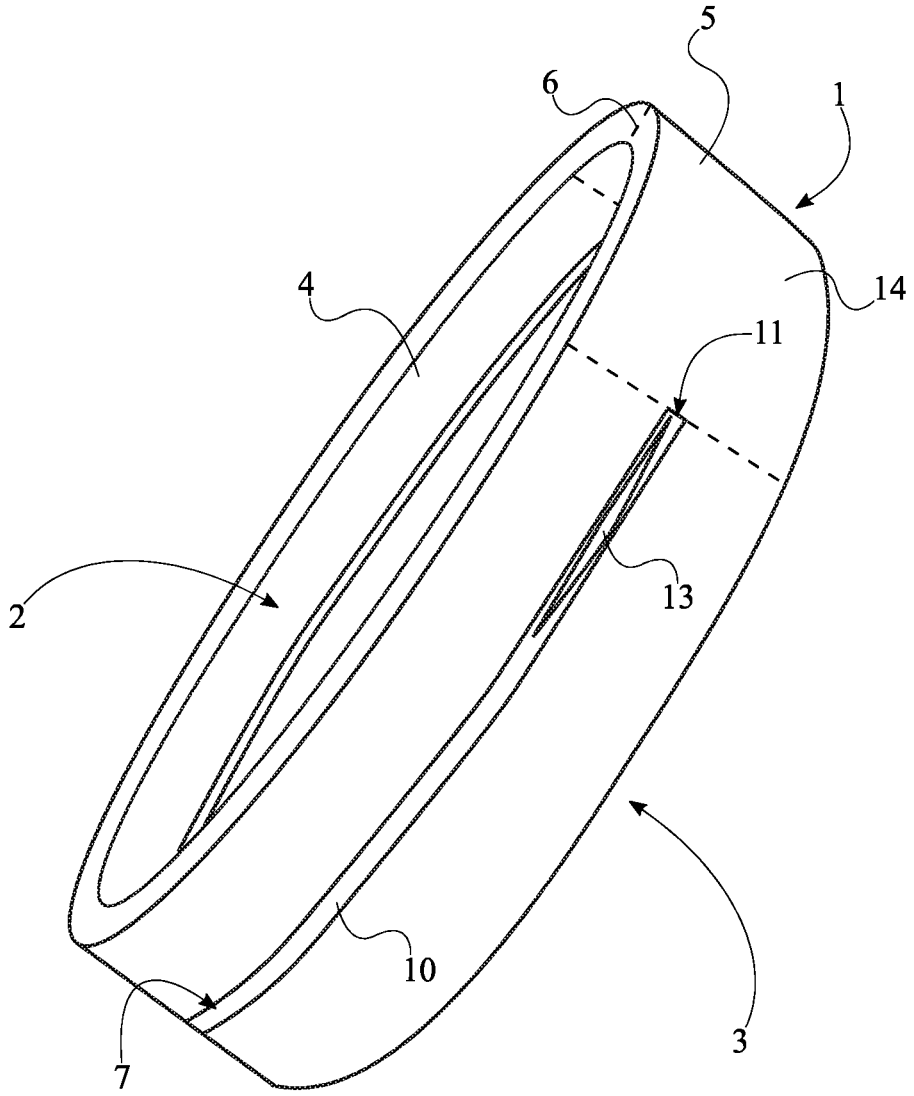
FIG. 4 is a front perspective view an alternate embodiment of the present invention with stabilizing segment.
Figure 5:
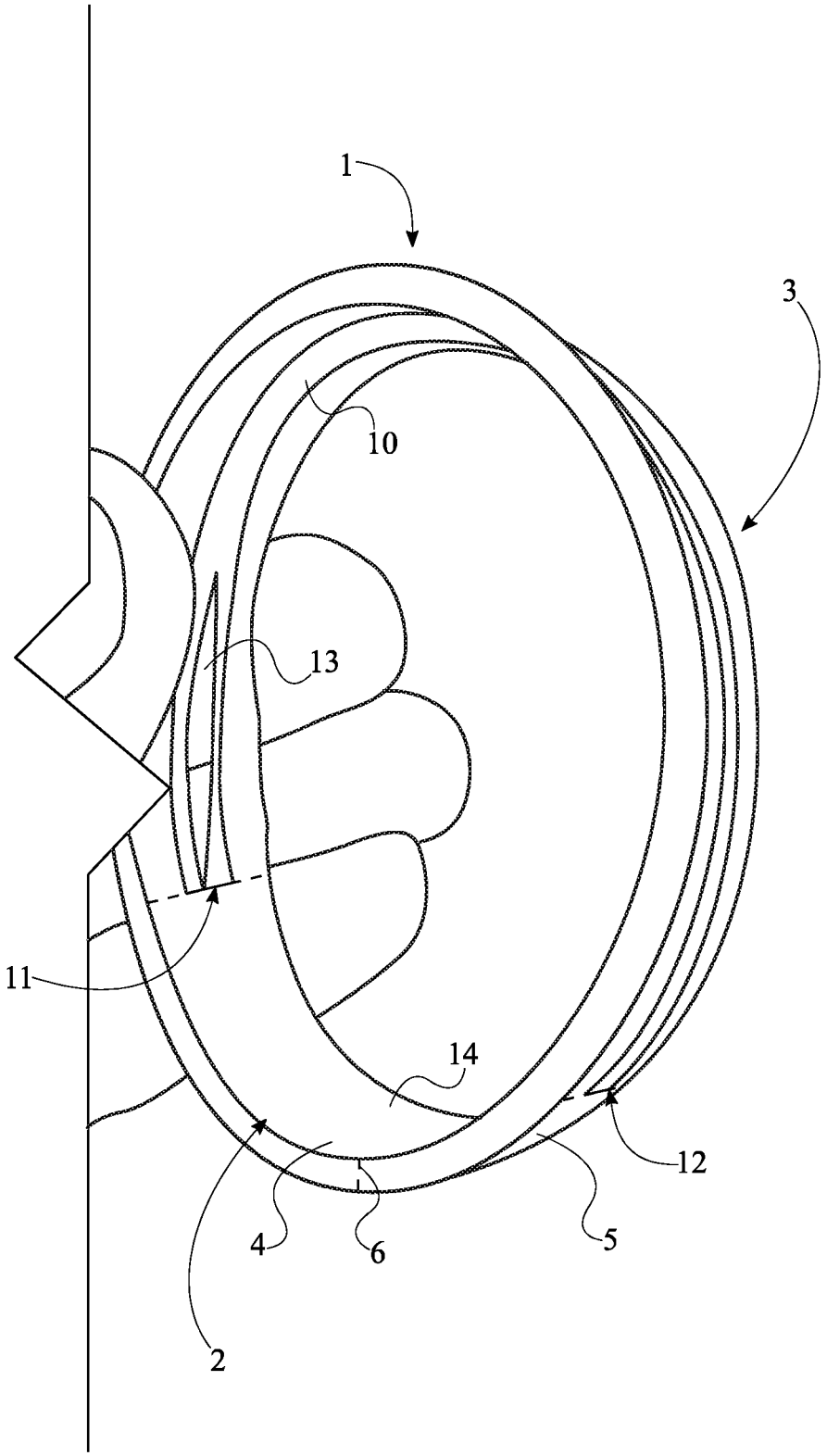
FIG. 5 is a rear perspective view the alternate embodiment of the present invention, held by a user.
Figure 6:
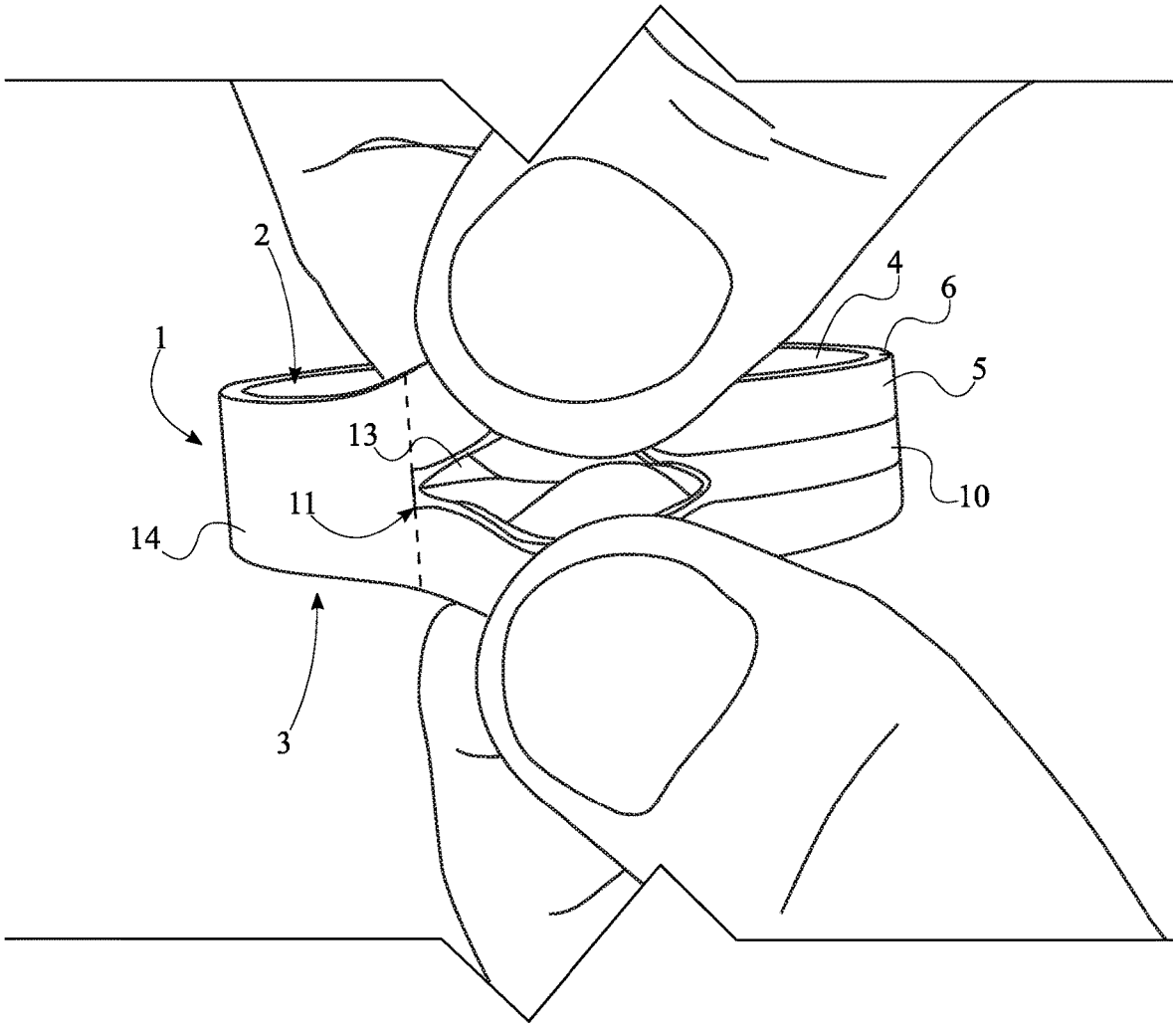
FIG. 6 is a front side view of the alternate embodiment of the present invention with a slit segment expanded.
Figure 7:
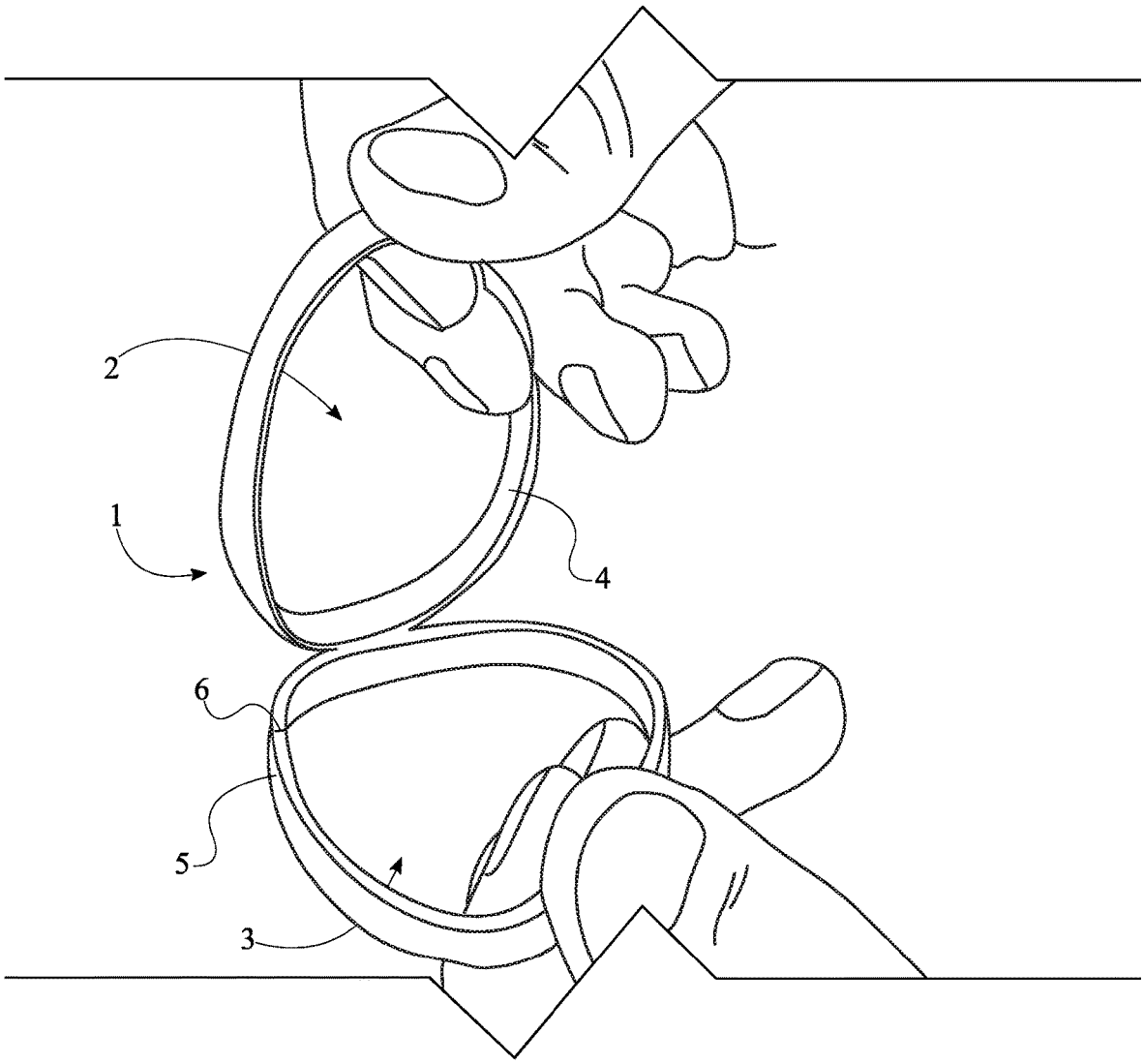
FIG. 7 is a front perspective view of the present invention, partially torn along an indented segment.
Figure 8:
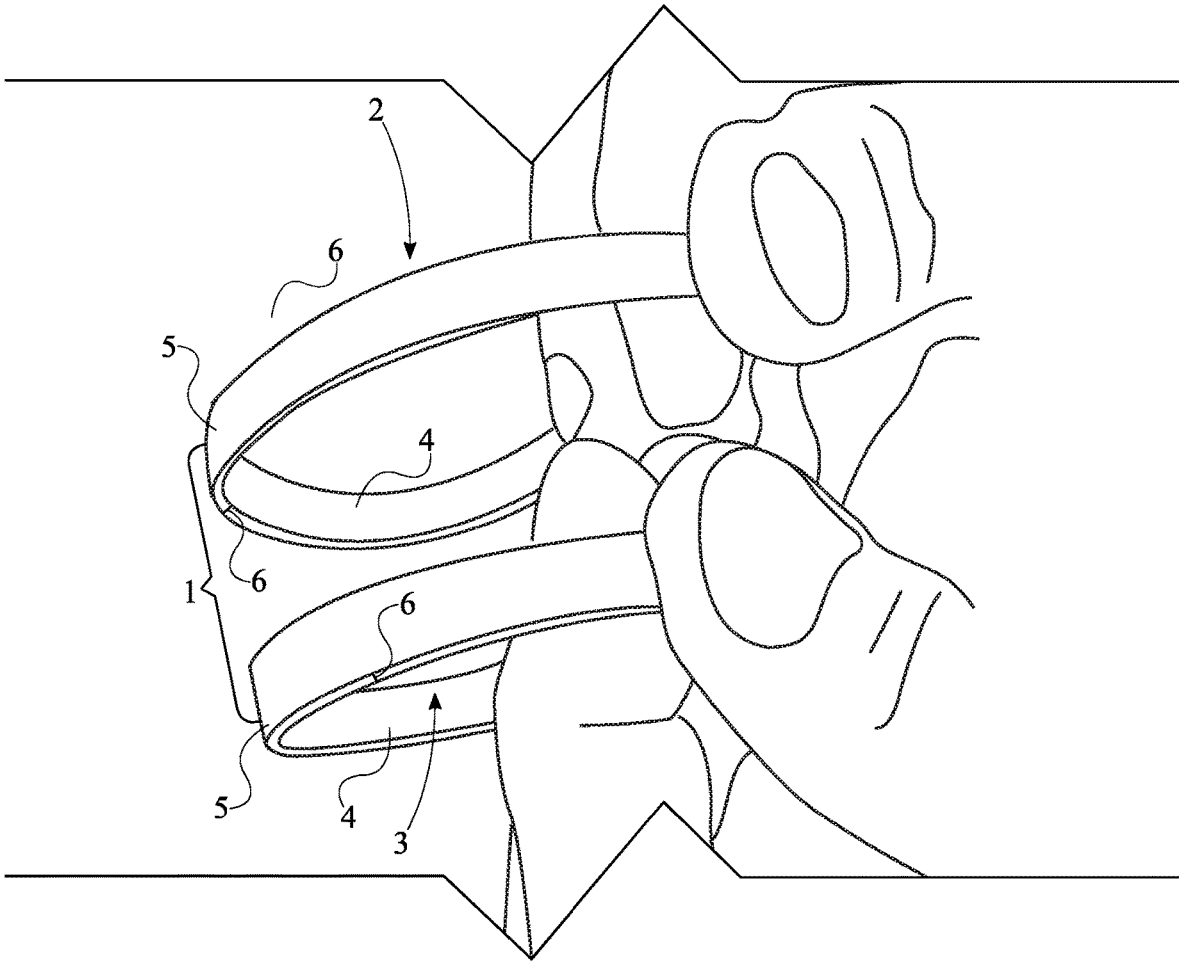
FIG. 8 is a front perspective view of the present invention, completely torn along the indented segment.

In the preferred embodiment of the present invention, a cross-section of the indented section is a quadrilateral shape, as seen in FIG. 3. The quadrilateral shape facilitates the separation of the tubular body 1 into at least two bracelets while maintaining a strong structure of the tubular body 1. In order for the tubular body 1 to be easily separated with simply the insertion of the tip of a finger into the slit segment 13, the tubular body 1 is made of an elastic, flexible material. More specifically, the tubular body 1 is made of silicone. Alternate embodiments of the present invention may comprise a tubular body that is made of various materials such as leather, vinyl, plastic, and so on.

Figure 11:
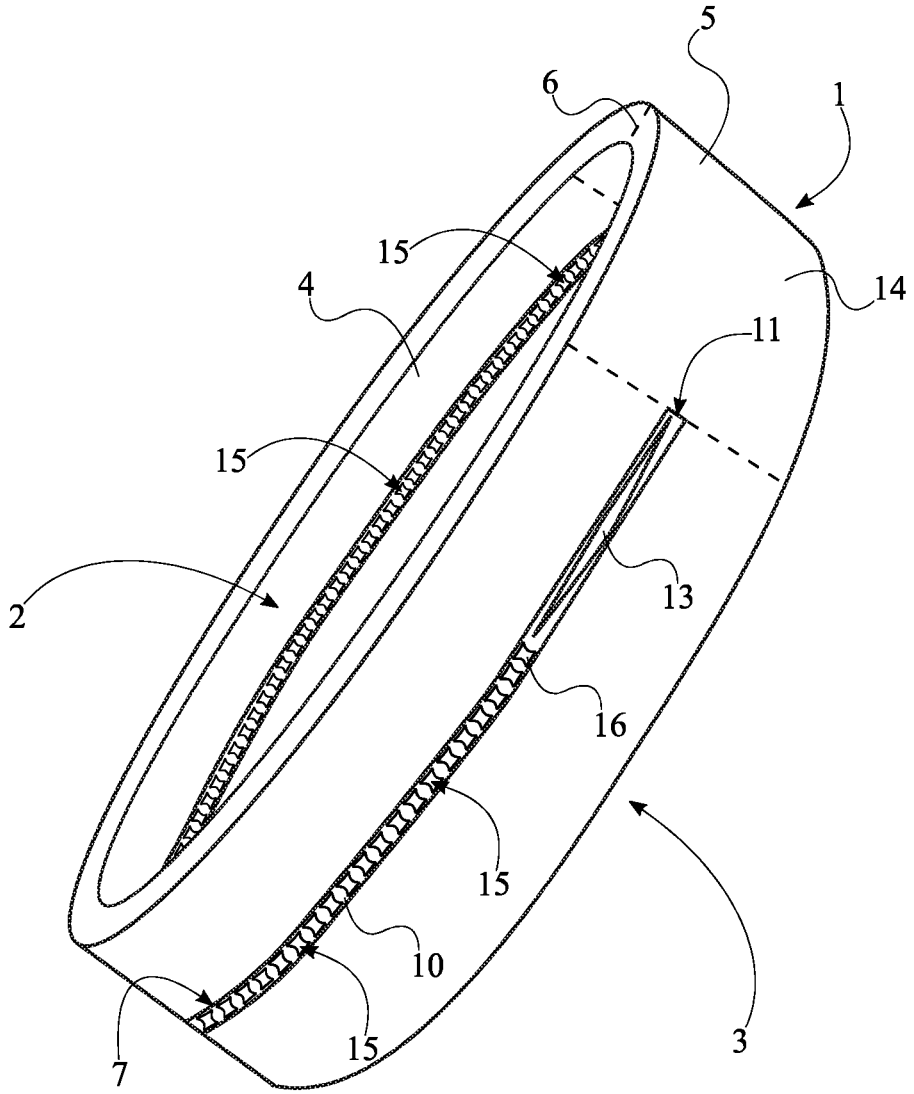
FIG. 11 is a front perspective view an alternate embodiment of the present invention with stabilizing segment and a series of perforated holes.
Figure 12:
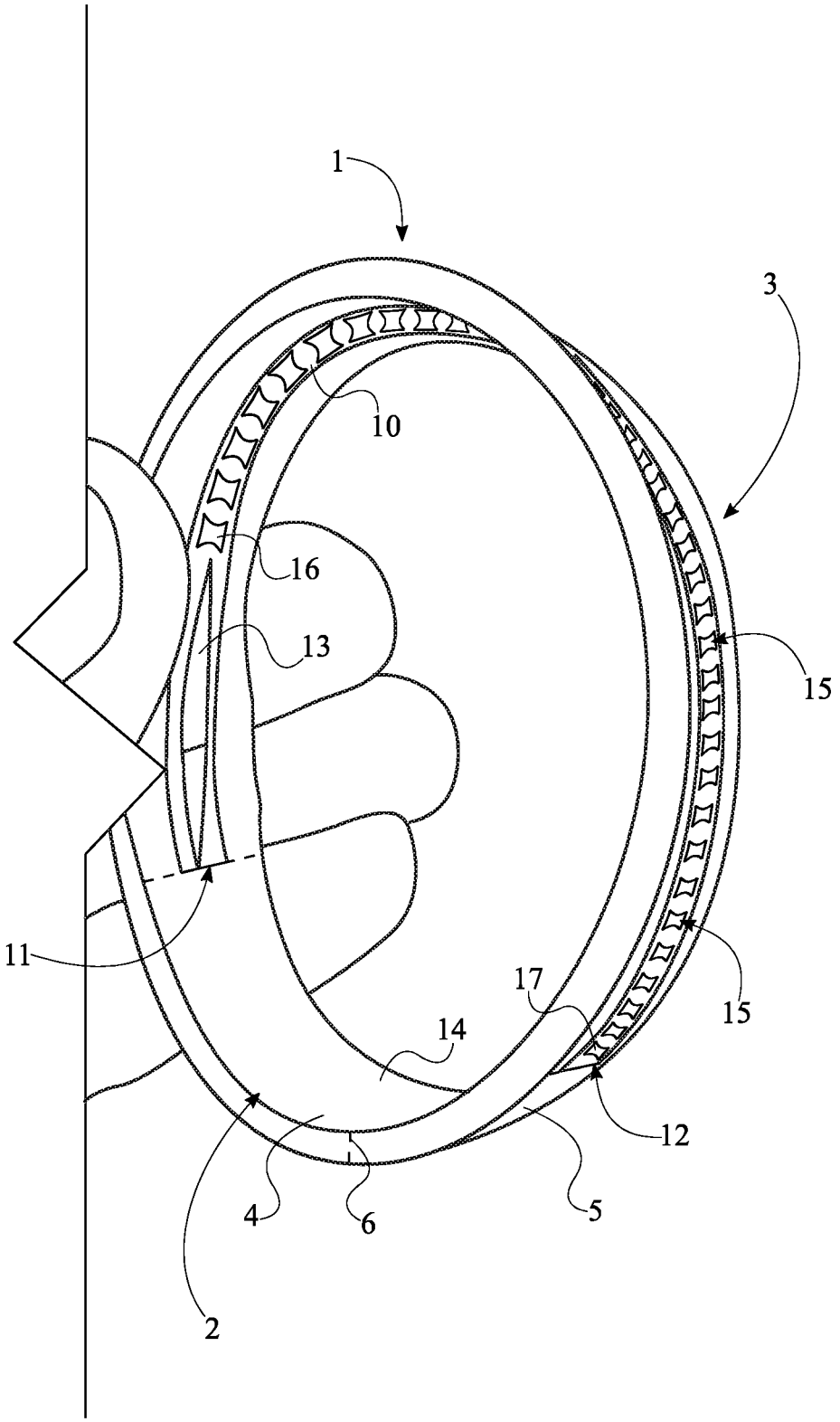
FIG. 12 is a rear perspective view of the alternate embodiment of the present invention with stabilizing segment and a series of perforated holes.

In order to facilitate the separation of the tubular body into at least two bracelets and vary the aesthetic of the present invention, the at least one separation track 7 of alternate embodiments of the present invention comprises a series of perforation holes 15 and a slit segment 13. The series of perforation holes 15 requires less force and effort to separate the tubular body 1 along the at least one separation track 7. As seen in FIG. 11 and FIG. 12, the series of perforation holes 15 comprises a first hole 16 and a last hole 17. Each hole within the series of perforation holes 15 laterally traverses through the tubular body 1 from the outer surface 5 to the inner surface 4 thereby minimizing the connection between the at least two bracelets. Similar to the preferred embodiment of the present invention, the slit segment 13 laterally traverses though the tubular body 1 from the outer surface 5 to the inner surface 4 and is circumferentially positioned in between the first hole 16 and the last hole 17. The at least one separation track 7 may further comprise a stabilizing segment 14 as well. In this alternate embodiment, the stabilizing segment 14 is circumferentially positioned in between the slit segment 13 and the last hole 17.

Although the invention has been explained in relation to its preferred embodiment, it is to be understood that many other possible modifications and variations can be made without departing from the spirit and scope of the invention as hereinafter claimed.

What is claimed is:

1. A separable bracelet band comprises:
- a tubular body;
- at least one separation track;
- the tubular body comprises a first open end, a second open end, an inner surface, and an outer surface;
- the at least one separation track being positioned in between the first open end and the second open end;
- the at least one separation track being circumferentially integrated around the tubular body;
- the at least one separation track comprises an indented segment and a slit segment;
- the indented segment comprises a first end and a second end;
- the indented segment laterally traversing into the tubular body from the outer surface;
- the slit segment laterally traversing through the tubular body from the outer surface to the inner surface; and
- the slit segment being circumferentially positioned in between the first end and the second end.

2. The separable bracelet band as claimed as claim 1 comprises:
- the at least one separation track being a single track; and
- the single track being positioned equidistant between the first open end and the second open end.

3. The separable bracelet band as claimed as claim 1 comprises:
- the at least one separation track being a plurality of tracks; and
- the plurality of tracks being equally distributed along the tubular body.

4. The separable bracelet band as claimed as claim 1 comprises:
- a wall thickness of the tubular body being positioned in between the inner surface and the outer surface; and
- the indented segment laterally traversing 90% of the wall thickness.

5. The separable bracelet band as claimed as claim 1 comprises:
- the at least one separation track further comprises a stabilizing segment; and
- the stabilizing segment being circumferentially positioned in between the slit segment and the second end.

6. The separable bracelet band as claimed as claim 1, wherein a cross-section of the indented segment and the outer surface delineate a quadrilateral shape.

7. The separable bracelet band as claimed as claim 1 comprises:
- the at least one separation track comprises a series of perforation holes;
- the series of perforation holes comprises a first hole and a last hole;

each within the series of perforation holes laterally traversing through the tubular body from the outer surface to the inner surface; and the silted segment being circumferentially positioned in between the first hole and the last hole.

8. The separable bracelet band as claimed as claim 7 comprises:

the at least one separation track further comprises a stabilizing segment; and the stabilizing segment being circumferentially positioned in between the silted segment and the last hole.

9. The separable bracelet band as claimed as claim 1, wherein the tubular body is made of an elastic, flexible material.

10. The separable bracelet band as claimed as claim 9, wherein the tubular body is made of silicone.

11. A separable bracelet band comprises:

a tubular body;

at least one separation track;

the tubular body comprises a first open end, a second open end, an inner surface, and an outer surface;

the at least one separation track being positioned in between the first open end and the second open end;

the at least one separation track being circumferentially integrated around the tubular body;

the at least one separation track comprises an indented segment, a slit segment, and a stabilizing segment;

the indented segment comprises a first end and a second end;

the indented segment laterally traversing into the tubular body from the outer surface;

the slit segment laterally traversing through the tubular body from the outer surface to the inner surface;

the slit segment being circumferentially positioned in between the first end and the second end; and the stabilizing segment being circumferentially positioned in between the slit segment and the second end.

12. The separable bracelet band as claimed as claim 11 comprises:

the at least one separation track being a single track; and the single track being positioned equidistant between the first open end and the second open end.

13. The separable bracelet band as claimed as claim 11 comprises:

the at least one separation track being a plurality of tracks; and the plurality of tracks being equally distributed along the tubular body.

14. The separable bracelet band as claimed as claim 11 comprises:

a wall thickness of the tubular body being positioned in between the inner surface and the outer surface; and the indented segment laterally traversing 90% of the wall thickness.

15. The separable bracelet band as claimed as claim 11, wherein a cross-section of the indented segment and the outer surface delineate a quadrilateral shape.

16. The separable bracelet band as claimed as claim 11 comprises:

the at least one separation track comprises a series of perforation holes;

the series of perforation holes comprises a first hole and a last hole;

each within the series of perforation holes laterally traversing through the tubular body from the outer surface to the inner surface;

the silted segment being circumferentially positioned in between the first hole and the last hole; and the stabilizing segment being circumferentially positioned in between the silted segment and the last hole.

17. The separable bracelet band as claimed as claim 11, wherein the tubular body is made of an elastic, flexible material.

18. The separable bracelet band as claimed as claim 17, wherein the tubular body is made of silicone.

* * * * *